US007886734B2

(12) United States Patent
Jin

(10) Patent No.: US 7,886,734 B2
(45) Date of Patent: Feb. 15, 2011

(54) INFRARED REMOTE CONTROLLING WARM STOVE

(76) Inventor: Weidong Jin, 8/F, Noble Center, 1006 Fuzhong 3rd Road, Futian District, Shenzhen, Guangdong 518026 (CN)

( * ) Notice: Subject to any disclaimer, the term of this patent is extended or adjusted under 35 U.S.C. 154(b) by 784 days.

(21) Appl. No.: 11/885,114

(22) PCT Filed: Feb. 25, 2005

(86) PCT No.: PCT/CN2005/000228

§ 371 (c)(1),
(2), (4) Date: Aug. 27, 2007

(87) PCT Pub. No.: WO2006/089457

PCT Pub. Date: Aug. 31, 2006

(65) Prior Publication Data

US 2008/0163866 A1 Jul. 10, 2008

(51) Int. Cl.
*F24C 3/04* (2006.01)

(52) U.S. Cl. ..... 126/92 B; 126/92 AC

(58) Field of Classification Search ..... 126/92 B, 126/92 AC, 92 R

See application file for complete search history.

(56) References Cited

U.S. PATENT DOCUMENTS 5,492,055 A * 2/1996 Nevin et al. ..... 99/331

6,164,273 A * 12/2000 Waters ..... 126/92 B

FOREIGN PATENT DOCUMENTS

| | | | |
|---|---|---|---|
| CN | 2090484 | U | 12/1991 |
| CN | 2436879 | Y | 6/2001 |
| CN | 2517987 | Y | 10/2002 |
| CN | 2554506 | Y | 6/2003 |
| JP | 9-196381 | | 7/1997 |

OTHER PUBLICATIONS

ISA, Apr. 21, 2005.

* cited by examiner

*Primary Examiner*—Alfred Basichas
(74) *Attorney, Agent, or Firm*—Buchanan Ingersoll & Rooney PC

(57) ABSTRACT

The present invention discloses an infrared remote controlling warm stove for outdoor warming which includes head, hollow upright post and base. The head comprises air mixing chamber, infrared hood, reflex hat, baffle, burner assembly and burner controlling device that are fixed and connected in turn on the upper end of the hollow upright post. The burner assembly consists of burner, parent burner, nozzle, motorized valve assembly, gas intake pipe and pressure reducing valve assembly. The burner controlling device comprises program-controlled circuit board, and battery holder, solenoid valve and motor of the motorized valve assembly electrically connected to the program-controlled circuit board, thermocouple, oxygen-lacking detector and ignition needle at the parent burner, the flame detector beside the fire hole of burner, infrared receiver board with buttons and overturn switch set in the lateral part of the air mixing chamber. When the stove operates, the gas cylinder is emplaced, the circuit is turned on and batteries are inserted into the battery holder. In such case, the burner can be ignited through the parent fire to realize the burning of the remote controlling stove.

9 Claims, 4 Drawing Sheets

INFRARED REMOTE CONTROLLING WARM STOVE

TECHNICAL FIELD

The present invention relates to an outdoor warming device, and more particularly to an infrared remote controlling warm stove that generates heat through gas burning.

BACKGROUND OF THE INVENTION

Many areas in China are cold in winter and in order to keep warm when working outdoors, combustibles such as firewood, charcoal or coal are burnt, resulting in pollution to the environment and inconveniences. The Chinese patent 00207130.4 discloses a gas-fired stove for supplying heat. Said stove mainly includes body, secondary heat-absorbing device, gas-fired range, heating pipe, wind proofing cap and temperature controlling switch, which provides heat through the double-layer duct for direct gas firing. Although the problem of pollution is solved, the stove is inconvenient to be moved because it uses water as the heating medium. The Chinese patent 02226130.3 discloses a burner of a gas-fired infrared stove. At the central position of the base of said stove there is a round-hole joint. The base is designed with a shape of two steps, on which the internal and external meshes are respectively located. The cuplike burner cap is covered in the internal mesh and is supported by the upper part of external mesh. A spindly conical clearance comes into shape between the internal mesh and the cuplike burner cap. The burner is fixed on the upper part of the stove and on the lower part of the stove there is a base. The burner and the base are connected by an upright post. The improved structure of the burner of the stove has the advantages of preventing backfire and wind but also has weaknesses in the control of burning. Also, remote control of the stove is not realized and the appearance and the structure still need improvement so as to meet the requirement of outdoor warming.

SUMMARY OF THE INVENTION

The objective of the present invention is to provide an infrared remote controlling warm stove for outdoor warming, which can be remotely controlled, conveniently moved and expeditiously reassembled and which is also environmental friendly.

In order to achieve the objective of the present invention, the basic concept of the technical plan used in the present invention is to provide an infrared remote controlling warm stove comprising a head, a hollow upright post and a base, wherein said head comprises an air-mixing chamber, an infrared hood and a reflex hat fixed and connected in turn on the hollow upright post. A baffle is set between the infrared hood and the air-mixing chamber. A burner assembly that extends downward is set in the infrared hood and a burner controlling device is set in the air-mixing chamber.

Said burner assembly includes a burner extending downward to the air-mixing chamber through the baffle and a nozzle extending into the burner. A motorized valve assembly, a gas intake pipe and a pressure reducing valve assembly that are set inside the air-mixing chamber are connected in turn below the nozzle, wherein the motorized valve assembly includes motor, solenoid valve and electric control valve and is connected to the parent burner under the burner through pipes.

Said burner controlling device comprises a program-controlled circuit board whose input terminal is electrically connected to the battery holder while the output terminals are respectively and electrically connected to the solenoid valve and motor in the motorized valve assembly, the thermocouple, the oxygen-lacking detector and ignition needle fixed at the parent burner, the flame detector set beside the flame of the burner and the infrared receiver board with buttons set on the lateral part of the air-mixing chamber. An overturn switch is electrically connected between the output terminal of the program-controlled circuit board and the thermocouple.

A compensating weight mass and three supporting bars of the upright post are connected to the base, wherein the upper ends of the three supporting bars are fixed and connected to the lower ends of the hollow upright post by bolts and a gas cylinder case that covers the supporting bars and that can be moved up and down along the shaft of the hollow upright post is closely connected to the base. A rubber cover is set on the cirumferential of the hollow upright post.

The air-mixing chamber takes the shape of a warhead which is bigger in the upper part and smaller in the lower part. The following components are set on the infrared receiver board: terminals electrically connected to the output terminals of the program-controlled circuit board, ON button, OFF button, HIGH button, MODERATE button, LOW button, indicator and the infrared receiver that can receive signal from the remote control, all of which are electrically connected to the terminals. Air inlets are set on the air-mixing chamber and observation holes are set on the infrared hood. Handles and aeration holes are set on the gas cylinder case which, also, takes the shape of a warhead that is bigger in the upper part and smaller in the lower part.

After implementation of the above plan, the present invention has the following favorable effects as against the prior art: The head, the upright post and the base in the present invention employ the streamline structure and are simple, safe and can be moved and reassembled easily. In the inner space surrounded by the gas cylinder case and the upright post supporting bars on the base, the gas cylinder can be emplaced as the gas source and can be directly connected to the pressure reducing valve assembly in the burner assembly, so as to form a warm stove that supplies heat by burning gas. This stove is fit for outdoor warming and can meet the requirements in environmental protection. Equipment of the motorized valve assembly and the burner controlling device in the head can facilitate the regulation of flame or heat value which can be controlled by the infrared receiver board with buttons of the present invention. Besides, the instruction can be given through the remote control to achieve the control of the heat value remotely. A remote control can be used to control several different stoves.

Generally, this stove has the following advantages:

1. Reasonably structured and of elegant appearance.
2. Easy to operate, capable of controlling the stove and the heat value through the remote control as well as controlling the heat value through manual operation.
3. The crown shaped reflex hat is simple and dignified and can collect and reflect most of the heat.
4. Many stoves can share one remote control.

The detailed embodiments for the present invention are hereby described by reference to the following drawings.

DETAILED DESCRIPTION OF THE PREFERRED EMBODIMENT OF THE PRESENT INVENTION

Figure 1:
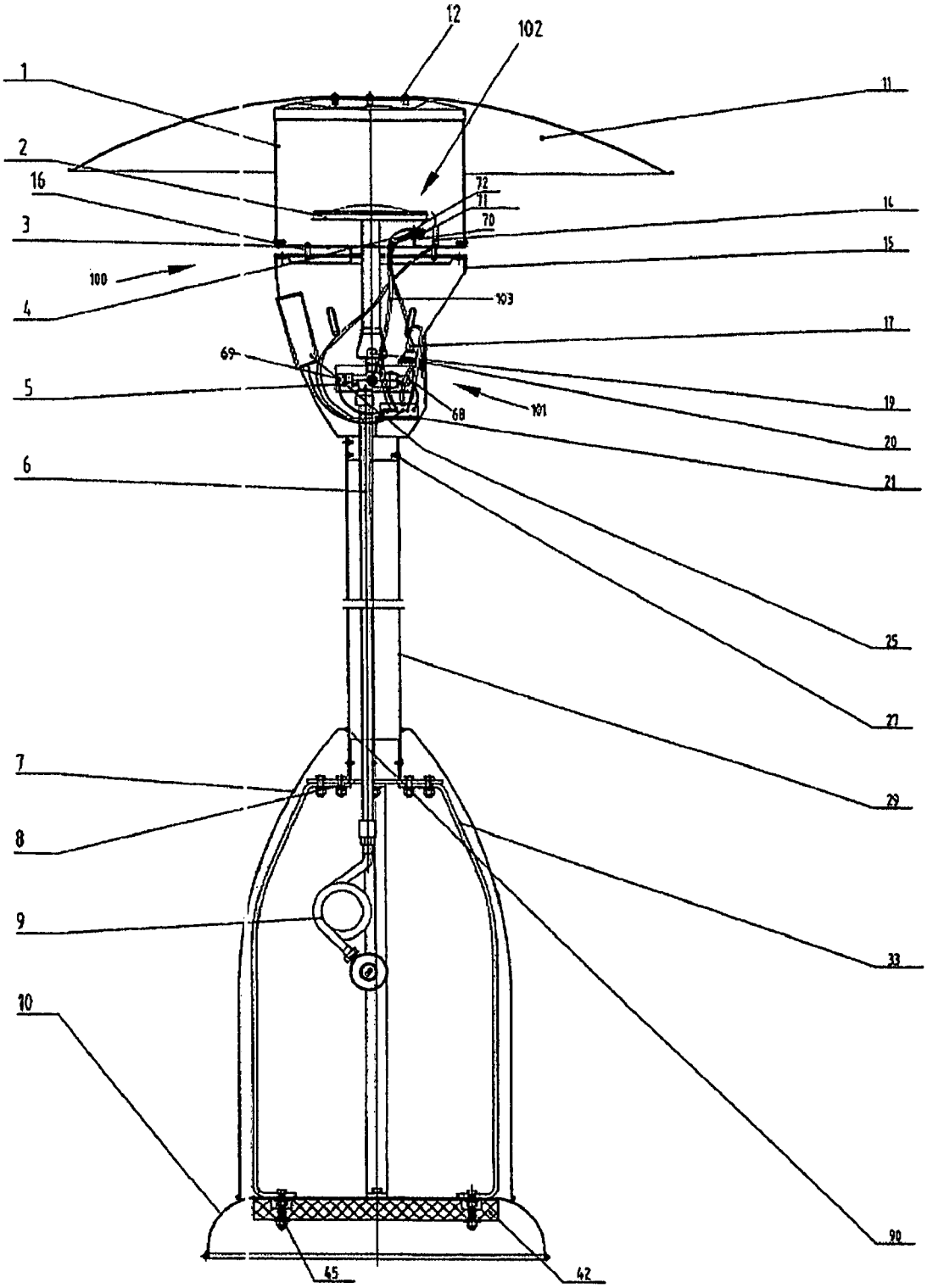
FIG. 1 is the schematic drawing of the overall structure of the stove of the present invention.
Figure 2:
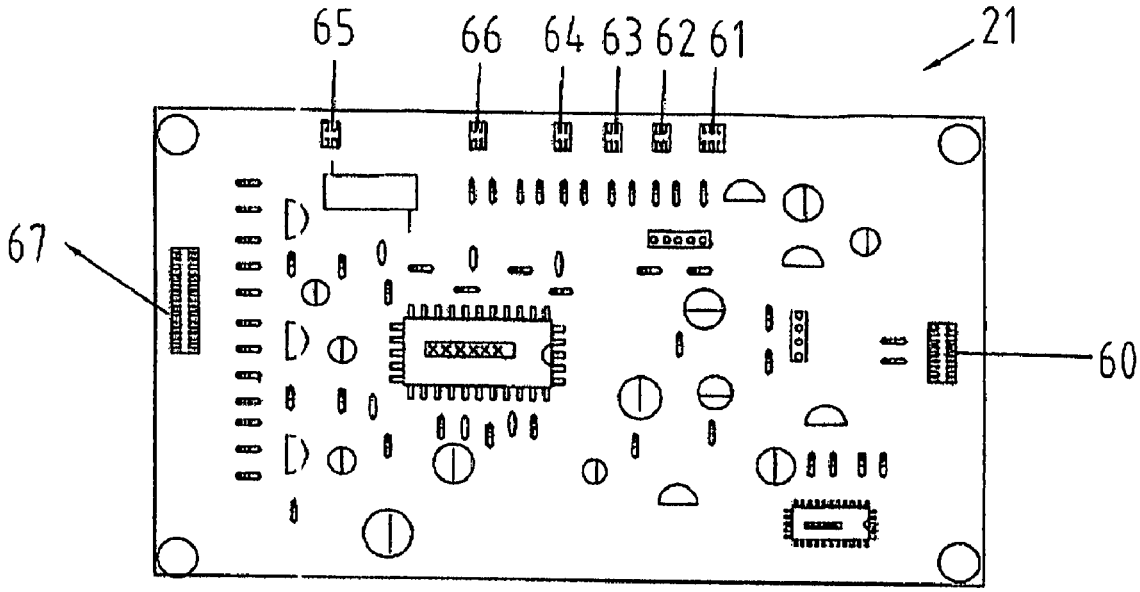
FIG. 2 is the schematic drawing of configuration for the program-controlled circuit board 21.
Figure 3:
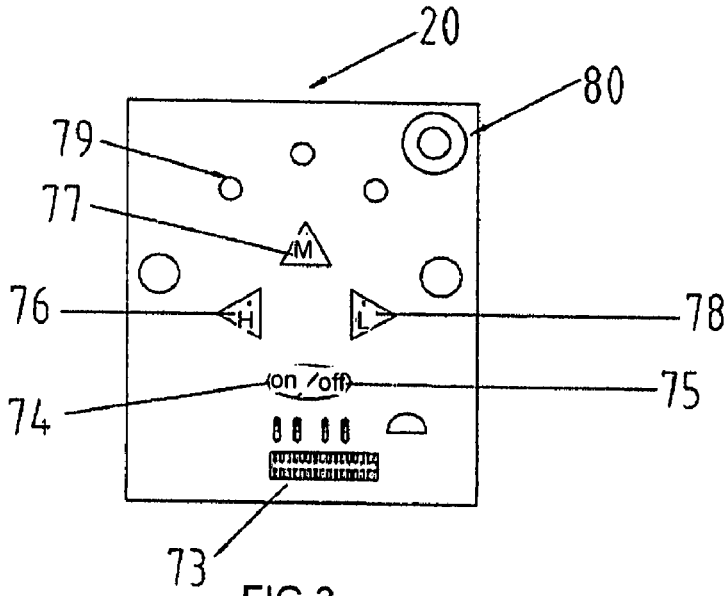
FIG. 3 is the schematic drawing of configuration for the infrared receiver board 20 with buttons in FIG. 1.
Figure 4:
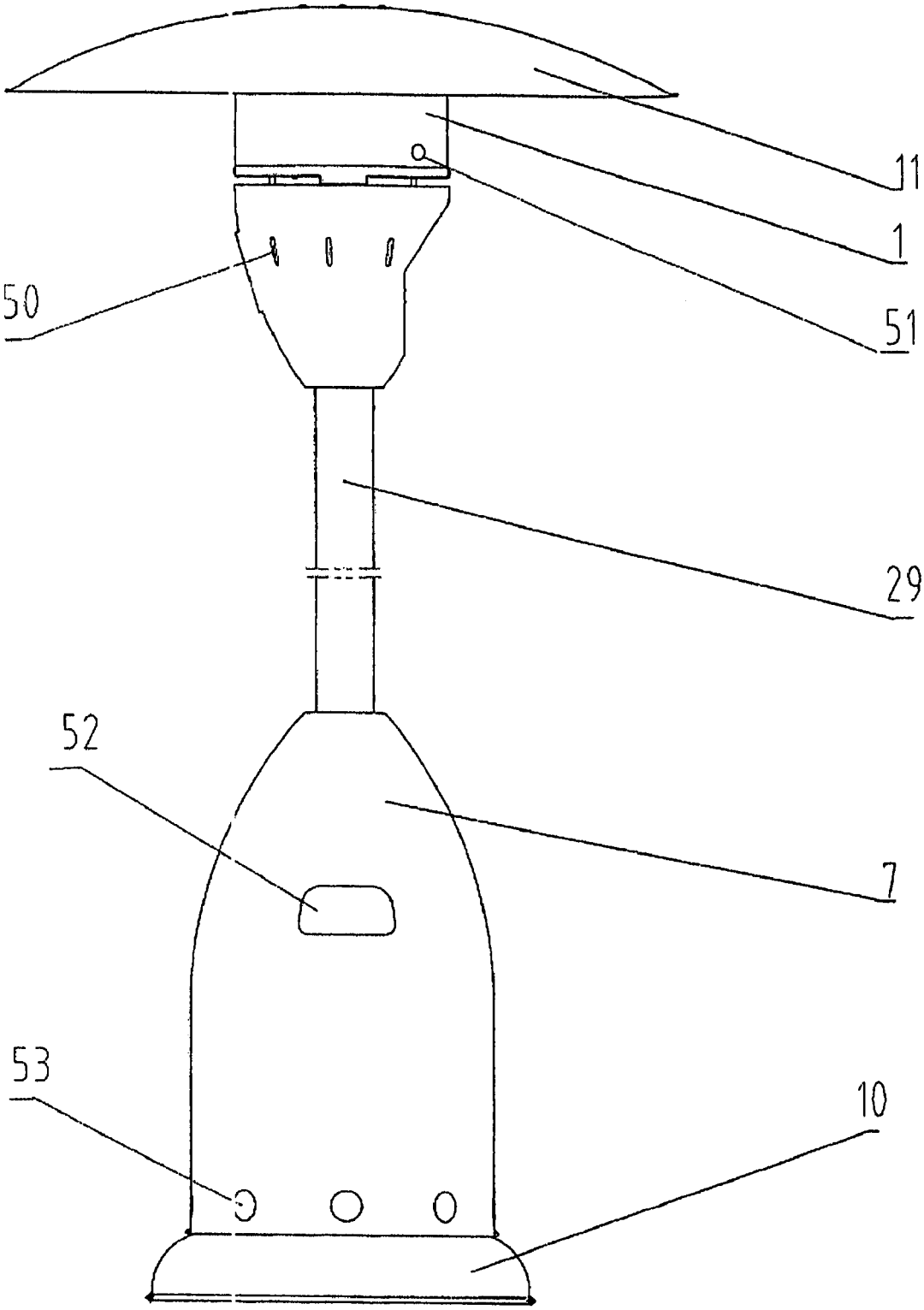
FIG. 4 is the schematic drawing of configuration of the stove of the present invention.

As shown in FIGS. 1, 2, 3, 4 and 5, the stove is of the streamline design and the structure of which comprises head 100, hollow upright post 29 and base 10. The head includes air-mixing chamber 15, infrared hood 1 and reflex hat 11 fixed and connected in turn to the upper end of the hollow upright post 29. There is a baffle 3 for thermal insulation between the infrared hood 1 and air-mixing chamber 15. In the infrared hood 1 there is a burner assembly 102 that can extend downward, and in the air-mixing chamber 15 there is a burner controlling device 101. Said burner assembly 102 comprises a burner 2 extending downward to the air-mixing chamber 15 through the baffle 3, a nozzle 19 extending into the burner 2, a motorized valve assembly 5, a gas intake pipe 6 and a pressure reducing valve assembly 9 below the nozzle 19 that are connected in turn in the air-mixing chamber 15. The motorized valve assembly 5 includes motor 68, solenoid valve 69 and electric control valve 91 that are connected to the parent burner under the burner 2 through pipe 103. The burner controlling device 101 comprises program-controlled circuit board 21 whose input terminal 60 is electrically connected to the battery holder 25 while the output terminals 61, 62, 63, 64, 65, 66 and 67 are respectively and electrically connected to the solenoid valves 69 and motor 68 in the motorized valve assembly 5, the thermocouple 70, the oxygen-lacking detector 71, abbreviated to ODS detector, and ignition needle 72 fixed at the parent burner 4, the flame detector 14 beside the fire hole of the burner 2, the infrared receiver board 20 with buttons set in the lateral part of the air-mixing chamber 15. Between the output terminal 63 and thermocouple 70 on the program-controlled circuit board 21 there is an electrically connected overturn switch 17. As shown in FIG. 2, the following components are set on the infrared receiver board 20: terminals 73 electrically connected to the output terminals 67 of the program-controlled circuit board 21, ON button 74, OFF button 75, HIGH button 76, MODERATE button 77, LOW button 78, indicator 79 and the infrared receiver 80 that can receive signal from the remote control 200, all of which are electrically connected to the terminals 73. As shown in FIG. 1, compensating weight mass 42 and three supporting bars 33 of the upright post are fixed and connected on base 10 by bolts 45. The upper ends of the three supporting bars 33 of the upright post are fixed and connected to the lower ends of the hollow upright post 29 by bolts 8. In addition, a gas cylinder case 7 that covers the supporting bars 33 and that can be moved up and down along the shaft of the hollow upright post 29 is closely muffcoupled on the base 10. A rubber cover 90 is set on the cirumferential of the hollow upright post 29. As shown in FIG. 4, the air-mixing chamber 15 takes the shape of a warhead which is bigger in the upper part and smaller in the lower part. The air inlets 50 are set on the air-mixing chamber 15 and there are observation holes 51 on the infrared hood 1. The gas cylinder case 7 also takes the shape of a warhead which is bigger in the upper part and smaller in the lower part. And there are handles 52 and aeration holes 53 on the gas cylinder case 7.

The stove using propane as the gas source with a pressure of 2800 pa is mainly applied to outdoor warming. The gas cylinder loaded with propane is emplaced on the base 10 and in the inner space among the three supporting bars 33 of the upright post. (not shown in the drawings). Such a 5-11 kg gas-cylinder is easy to be placed in the aforesaid inner space due to that the gas cylinder case can be moved up and down. The gas cylinder is connected to the pressure reducing valve assembly 9 and after two AAA batteries (2×1.5V) are inserted in the battery holder 25, the stove can be put into use. When released, the gas in the gas cylinder can flow through the pressure reducing valve assembly 9, gas intake pipe 6, motorized valve assembly 5, nozzle 19 and parent burner 4 into the burner 2, and then ignite the burner 2 through patent fire at the parent burner and induces combustion in the chamber i.e. infrared hood 1. The program-controlled circuit board 21 and motorized valve assembly 5 are in charge of the control of gas burning. The infrared hood 1 is heated and its temperature rises to above 600 and radiates heat to the outside evenly. Some radiation is reflected by the reflex hat 11 to the needed area so as to achieve the effect of warming. The baffle 3 between the infrared hood 1 and the air-mixing chamber 15 can effectively and absolutely separate the air-mixing chamber 15 and the infrared hood 1 (the burning chamber) of different temperatures so as to ensure the operation of the motorized valve assembly 5 and the burner controlling device 101 and adjust the flame or heat value and meet the requirements of automatic protection of accidental extinguishing of fire.

Figure 5:
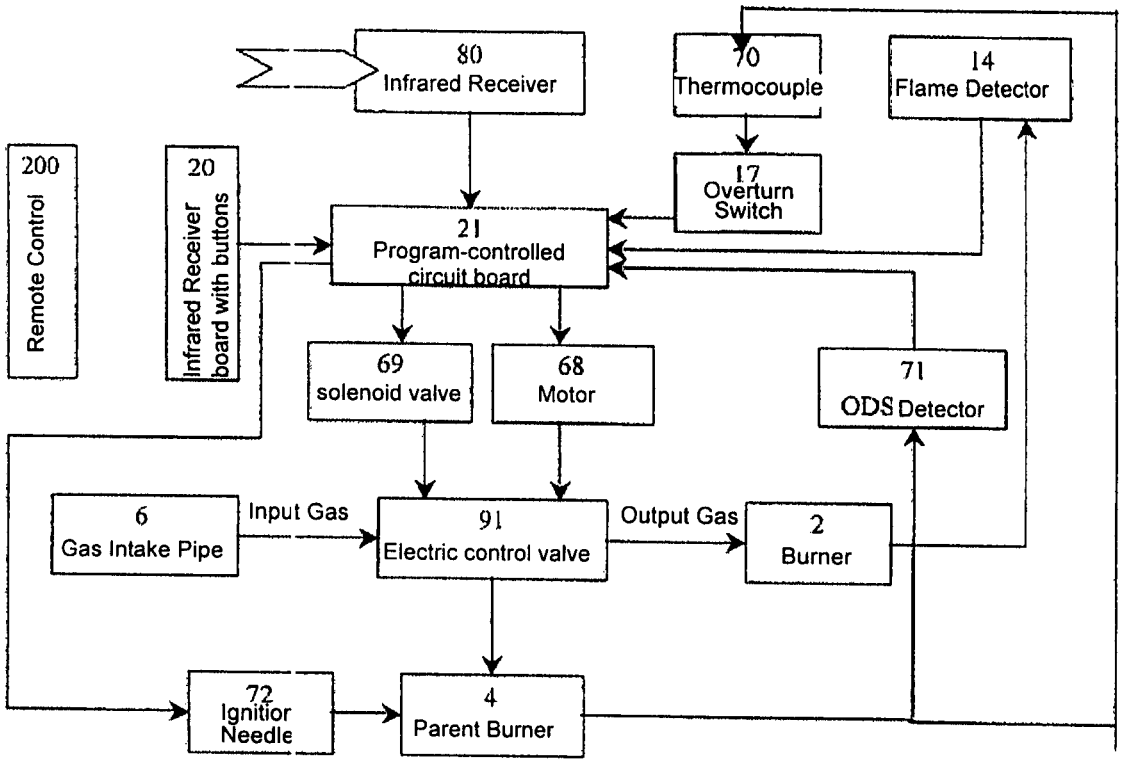
FIG. 5 is the schematic diagram of the stove of the present invention.

Please refer to FIG. 5 for the control principle of the stove of the present invention.

Automatic control means of the present invention are described in this paragraph. The command is given out through the remote control 200 or pressing the buttons, which is received by the infrared receiver 80 (see FIG. 3) and the signal is transmitted to the program-controlled circuit board 21 connected with the battery holder 25 (not shown in FIG. 5). The gas is released and the motorized valve assembly 5 opens the gas source of parent fire of the parent burner 4 according to the command from the program-controlled circuit board 21, and fire is automatically lighted by the ignition needle 72. The gas source of burner 2 is opened after 2 seconds and the gas is fed into the electric control valve 91 through the gas intake pipe 6 and then into the burner 2. Finally, fire is ignited by the parent fire in the parent burner 4 so as to make the burner working. The remote control 200 or the buttons can be used to turn on, turn off and adjust the flame or heat value and the remote control 200 can be used for many stoves.

Automatic protection means of the present invention are described in this paragraph. The thermocouple on the parent burner 4 is warmed up due to the burning of parent fire and generates a current which runs through the overturn switch and instructs the program-controlled circuit board 21 so as to open the motorized valve assembly 5. In case of accidental extinguishing of fire, the thermocouple 70 is not warmed or the overturn switch 17 or ODS detector 71 takes action, all of which can make the program-controlled circuit board 21 issue the command of turnoff so as to avoid leakage of gas. On the other hand, the flame detector 14 fixed beside the fire hole of the burner 2 will generate a current when there is a flame, making the program-controlled circuit board 21 issue the command to make the electric control valve assembly 5 maintain on state. When there is no flame, the flame detector 14 will generate a bias current to the program-controlled circuit board 21 which issue the command to turn off the motorized valve assembly 5 so as to avoid gas leakage.

The invention claimed is:

1. An infrared remote controlling warm stove comprises a head, a hollow upright post and a base, wherein the head comprises an air-mixing chamber, an infrared hood and a reflex hat fixed and connected in turn on the upper end of the hollow upright post; a baffle is set between the infrared hood and the air-mixing chamber; a burner assembly that extends downward is set in the infrared hood; and a burner controlling device is set in the air-mixing chamber;

wherein said burner controlling device comprises a program-controlled circuit board whose input terminal is electrically connected to a battery holder while output terminals and are respectively and electrically connected to solenoid valves and motor in a motorized valve assembly, thermocouple, oxygen-lacking detector and ignition needle fixed at a parent burner, flame detector beside a fire hole of the burner, infrared receiver board with buttons beside the air-mixing chamber, wherein an overturn switch is electrically connected between the output terminal of the program-controlled circuit board and the thermocouple.

2. The infrared remote controlling warm stove as described in claim 1, wherein said burner assembly comprises a burner extending downward to the air-mixing chamber through the baffle; a nozzle extending into the burner is set on the lower end of the burner; and motorized valve assembly, gas intake pipe and pressure reducing valve assembly below the nozzle are connected in turn in the air-mixing chamber, wherein the motorized valve assembly comprises motor, solenoid valve and electric control valve and is connected to parent burner under the burner through pipe.

3. The infrared remote controlling warm stove as described in claim 1, wherein a compensating weight mass and three supporting bars of the upright post are fixed on the base, wherein upper ends of the three supporting bars are fixed and connected to lower ends of the hollow upright post by bolts and a gas cylinder case that covers the supporting bars and that can be moved up and down along the shaft of the hollow upright post is coupled on the base.

4. The infrared remote controlling warm stove as described in claim 3, wherein handles and aeration holes are set on the gas cylinder case.

5. The infrared remote controlling warm stove as described in claim 3, wherein the gas cylinder case is bigger in the lower part and smaller in the upper part.

6. The infrared remote controlling warm stove as described in claim 1, wherein a rubber cover is set on a circumference of the hollow upright post.

7. The infrared remote controlling warm stove as described in claim 1, wherein said air-mixing chamber is bigger in an upper part and smaller in a lower part.

8. The infrared remote controlling warm stove as described in claim 1, wherein following components are set on the infrared receiver board: terminals electrically connected to the output terminals of the program-controlled circuit board, ON button, OFF button, HIGH button, MODERATE button, LOW button, indicator and the infrared receiver that can receive signal from a remote control, all of which are electrically connected to the terminals.

9. The infrared remote controlling warm stove as described in claim 1, wherein air inlets are set on the air-mixing chamber and observation holes are set on the infrared hood.

* * * * *